United States Patent [19]

Mooradian

[11] 3,957,630

[45] May 18, 1976

[54] ADJUSTABLE MATERIALS FEEDING APPARATUS

[75] Inventor: Albert H. Mooradian, Winchester, Mass.

[73] Assignee: Raytheon Company, Lexington, Mass.

[22] Filed: May 22, 1975

[21] Appl. No.: 580,377

[52] U.S. Cl. ..... 209/136; 209/147; 209/152; 198/91; 198/44

[51] Int. Cl.[2] ..... B07B 4/06

[58] Field of Search ..... 198/94, 91, 95, 104, 198/44; 209/134–139 R, 140, 141, 147, 152, 284, 288, 294, 297, 298, 257, 473, 482

[56] References Cited

UNITED STATES PATENTS

| | | | |
|---|---|---|---|
| 1,186,874 | 6/1916 | Baer | 209/152 |
| 1,981,318 | 11/1934 | James | 209/152 X |
| 2,173,177 | 9/1939 | Menk | 198/94 X |
| 2,514,993 | 7/1950 | Ernst | 198/94 X |
| 3,393,791 | 7/1968 | Heitzer | 198/89 X |
| 3,458,040 | 7/1969 | Schmid | 209/152 X |
| 3,458,041 | 7/1969 | Schmid | 209/152 X |
| 3,508,646 | 4/1970 | Conrad et al. | 209/45 X |
| 3,595,391 | 7/1971 | Schmid | 209/152 X |
| 3,804,249 | 4/1974 | Gibbons et al. | 209/482 |

*Primary Examiner*—Frank W. Lutter
*Assistant Examiner*—Ralph J. Hill
*Attorney, Agent, or Firm*—Harold A. Murphy; Joseph D. Pannone; John T. Meaney

[57] ABSTRACT

A materials separating apparatus which comprises a conveyor on which materials to be separated are deposited and conveyed to a hopper mounted on an adjustable platform, a rotary drum air classifier mounted on said platform, and transport mechanism connecting the hopper with the interior of the drum whereby materials may be moved from the hopper to the drum for separation therein, the platform being movable together with the hopper and drum whereby the drum may be positioned at a selected angle of inclination, and the conveyor and hopper being interconnected in a manner whereby the conveyor remains in position for proper deposit of materials in the hopper regardless of the position of the hopper when the platform is moved.

8 Claims, 6 Drawing Figures

ADJUSTABLE MATERIALS FEEDING APPARATUS

BACKGROUND OF THE INVENTION

In known air classifier systems there is provided a rotary drum classifier which is positioned at a fixed angle of inclination so that a stream of air may be made to flow through the drum at a fixed velocity to separate materials deposited within the drum. Such materials are usually transported to the drum by a conveyor which has one end extended into the drum so that the materials may be deposited therein at a point near the longitudinal center of the drum.

It is also known that the angle of inclination of the drum may be changed, if desired. This will effectively alter the velocity of the air flowing through the drum and so change the ratio of lights-to-heavies in the materials being separated. In some known systems the higher end of the drum is positioned within an opening in a separate fixed processing chamber such as a plenum, for example. In such a case the angle of inclination of the drum must be changed by raising or dropping the lower end of the drum, even though a conveyor or other feed device is mounted within this end. However, it will be apparent that with a conveyor penetrating a substantial distance into the drum, this will create difficulties in the achievement of such angle change, especially if the conveyor is relatively larger or the drum diameter is relatively short.

If the drum receives its supply of materials from a supply hopper which is mounted on the same adjustable platform as the drum, difficulties are created when the hopper is moved, since the hopper usually is loaded by a separate conveyor. Thus, movement of the hopper, when the platform is adjusted, may move the hopper out of proper spacial relationship with the conveyor. This problem is particularly acute when the hopper supports one end of a feed screw by which the drum is loaded and thus must be moved with the platform to retain proper relationship with the drum, particularly in cases where the hopper is adjustable independently with respect to the drum.

SUMMARY OF THE INVENTION

The above and other objections to prior art apparatus of the described character are overcome or improved upon by the present invention wherein the hopper-loading means includes a loading conveyor and a separate connecting section adjacent the hopper. This conveyor section has one end disposed in proper position with respect to the adjacent end of the loading conveyor so as to receive materials therefrom and to convey them directly to the hopper. One end of the connecting conveyor section is adjustably attached to the hopper and is constantly retained in a proper relationship therewith so as to always deposit materials properly in the hopper regardless of the position of the hopper.

More specifically, the connecting conveyor section is attached to the hopper and supported by hangers which are mounted on opposite ends of a shaft extending transversely of the conveyor and upon which is mounted the roller over which the adjacent portion of the conveyor belt is wound. The hangers each carry at least one roller which is positioned within a respective track fixed to the sides of the hopper adjacent its upper end. The opposite end of the connecting conveyor section is pivotally mounted beneath the adjacent end of the loading conveyor. Thus, when the hopper is raised and lowered the adjacent end of the connecting conveyor section follows by means of the hanger rollers and track, the conveyor section rotating about the axis of the pivotal connection at its other end.

According to this invention, therefore, the lower end of the drum, the hopper and drum feed device, and the adjacent end of the connecting conveyor are all movable up and down as the platform is raised and lowered to adjust the angle of inclination of the drum. Thus there is provided assurance that all these component parts of the system are constantly retained in proper cooperative functional space relationship.

BRIEF DESCRIPTION OF THE DRAWINGS

The above and other objectives and advantages of this invention will become apparent from the following description taken in connection with the accompanying drawings, wherein.

DESCRIPTION OF THE PREFERRED EMBODIMENTS

Figure 1:
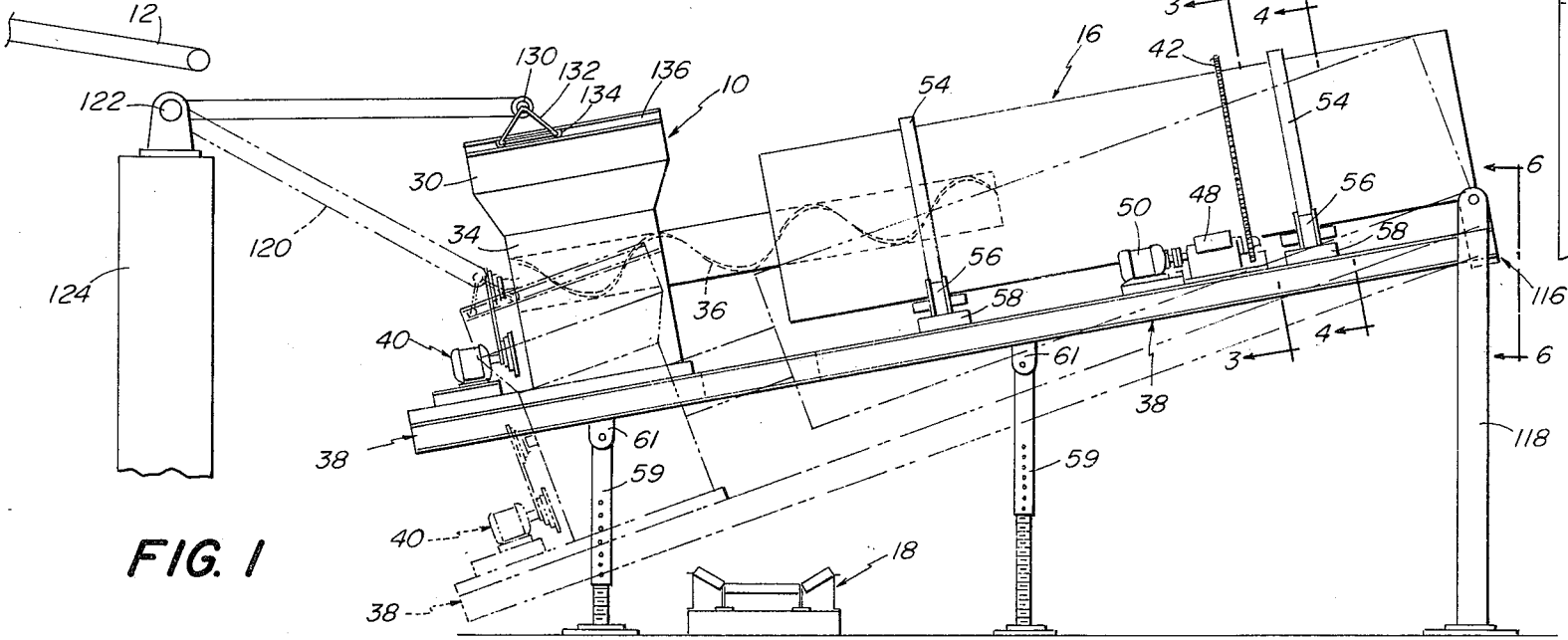
FIG. 1 is a front elevational view of air classifier apparatus embodying the invention.

Referring more particularly to the drawings wherein like characters of reference designate like parts throughout the several views, the apparatus shown in FIG. 1 includes a number of cooperating devices arranged to process and separate materials automatically in sequential fashion.

Figure 2:
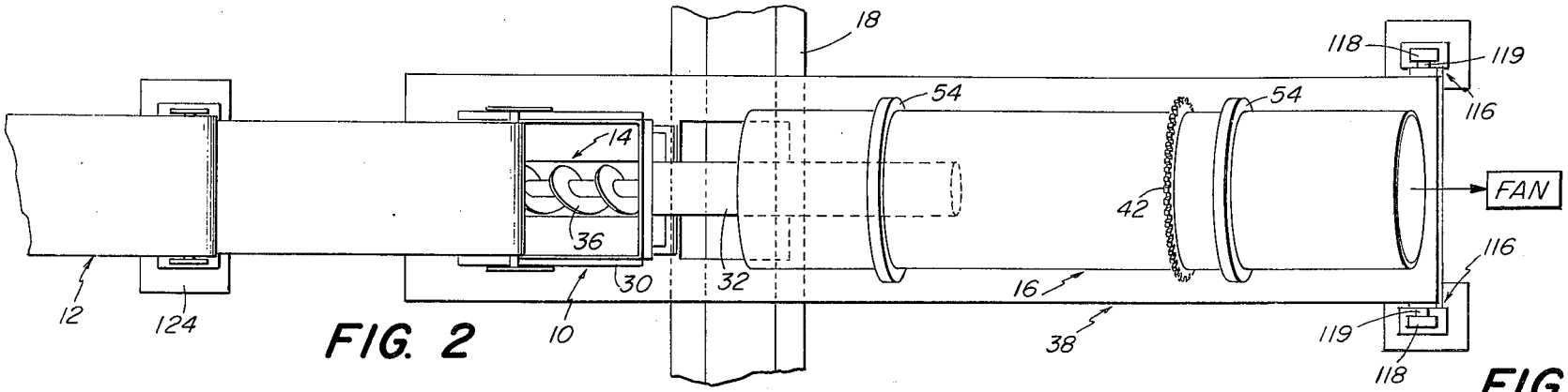
FIG. 2 is a top plan view of the apparatus shown in FIG. 1.

A feed hopper 10 receives shredded raw material from an adjacent conveyor 12 and directs it to a screw feed 14 which deposits it within a rotatable air drum classifier 16. The drum classifier separates the raw materials into light and heavy materials in the known fashion of devices of this character. The drum is angled at a selected inclination, such as 10° for example, and air is caused to flow through it at high velocity by means of a fan, for instance, as shown in FIG. 2. As raw materials drop from the end of the screw feed onto the bottom of the drum wall, the heavy materials will be rotated upwardly with the drum to a point where they will fall to a lower point within the drum. This action is repeated until eventually the heavy materials fall out of the lower end of the drum onto a conveyor 18 which will carry them away for further processing or disposal.

The light materials will be entrained within the high velocity air stream and will be carried out the upper end of the drum 16 for further processing or use.

The feed hopper 10 is provided with a bucket portion 30 at its upper end into which the raw materials are deposited from the conveyor 12. These raw materials have previously been shredded so that they comprise a mixture of raw material elements not exceeding about twelve inches in size, for example.

A feed duct or conduit 32 extends from the base 34 of the feed hopper 10 into the adjacent end of the drum 16. Within the duct 32 is a screw 36, one end of which is mounted in the hopper base 34 to receive the raw materials from bucket 30. Hopper 10 is mounted upon a suitable base or platform 38 which also supports the drum 16, as will be described.

Screw 36 is driven by a motor and chain drive 40 so that the raw materials will be moved along duct 32 into the drum interior. The duct is preferably open at its end within the drum, and is apertured at the bottom adjacent the end wall so that the heavier raw materials will fall through the aperture onto the drum wall preferably at a point within the first third of the length of the drum, while the lighter materials will be carried by the high velocity air stream out the upper end of the drum.

At a point midway of its length the drum is provided with a fixed circumferential sprocket wheel 42 which meshes with a chain link drive belt 44 carried by a pair of smaller sprocket wheels 46. One sprocket wheel 46 is rotatably mounted on one end of a reduction gear box 48 which is interconnected with drive motor 50 on platform 38 whereby rotation of the drum is accomplished. The second small sprocket wheel 46 is supported in any suitable manner as by a supporting bracket 52.

The platform 38 and consequently the drum 16 thereon is angled to a selected inclination, such as 10° for example. To prevent longitudinal displacement of the drum there are provided two fixed restraining rings or collars 54 extending around the circumference of the drum and spaced from respective ends thereof. Each ring 54 engages a respective pair of rollers 56 mounted by suitable bearings in a support 58 carried by the platform 38. Flanges on the sides of the rollers 56 prevent longitudinal movement of the drum as it is rotated.

As shown in FIG. 1, the angle of inclination of the drum 16 may be altered to vary the velocity of the air flowing through the drum and to thereby vary the ratio of lights-to-heavies being separated within the drum. Such changing of the angle of inclination of the drum may be accomplished by means of threaded or telescopic jackposts 59, for example, which are suitably mounted beneath the drum 16 and attached to it as by clevis devices 61.

It is important in some installations to retain the upper end of the drum constantly in adjusted position with respect to other apparatus. Therefore, the upper end of the drum is pivoted as by a suitable bearing and shaft arrangement 116 carried preferably by the adjacent end of the platform 38 and pivotally mounted at the upper ends of fixed supports or standards 118. Thus, the platform 38 can be raised and lowered by manipulation of the posts 59, causing the drum to be angled about the axis of the pivotal connection 116.

Figure 6:
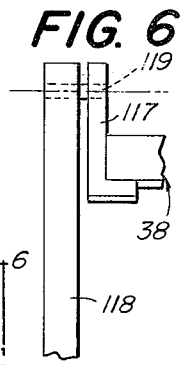
FIG. 6 is an enlarged fragmentary view of the pivotal suspension at the upper end of the rotary drum.

More specially, one type of suspension is illustrated in FIGS. 1, 2 and 6 and comprises an angle or rocker 117 which is pivotally connected to each respective standard 118 by means of pivot pins 119 which are aligned with the lower edge of the adjacent end of the drum 16. The platform 38 is supported by the rockers 117 and thus raising and lowering of the lower end of the platform will effect corresponding movement of the drum about the axis of pins 119.

Air at high velocity is forced through the drum 16 by means of fans or blowers, not shown, located in any convenient position.

Figure 3:
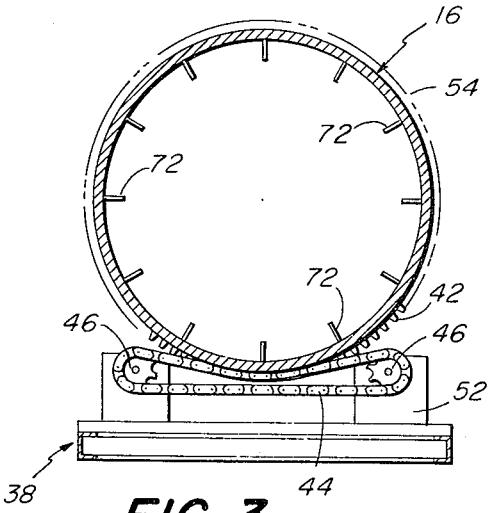
FIG. 3 is an enlarged sectional view taken substantially along line 3—3 of FIG. 1.
Figure 4:
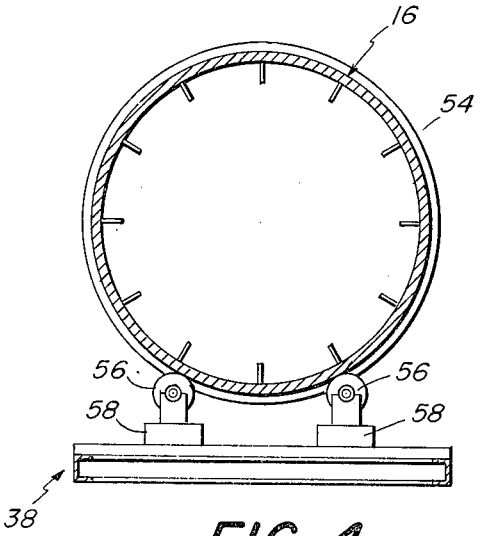
FIG. 4 is an enlarged sectional view taken substantially along line 4—4 of FIG. 1.

In the construction and operation of an air drum classifier of this sort, there are provided a series of spaced longitudinally extending ribs or vanes 72 (FIG. 3) on the inner wall of the drum 16 which function as lifters to raise the heavy materials, as the drum rotates, to a height from which they may be dropped again to the bottom of the drum. It will be understood that since the drum is inclined the heavy materials will be dropped nearer the lower end of the drum. Therefore, continued rotation of the drum and lifting and dropping of the heavy materials will move the materials toward the lower end of the drum until they eventually fall out of the drum onto conveyor 18. A considerable amount of the light materials emanating from the end portion of the feed duct 32 will be entrained in the high velocity air stream as the raw materials drop from the duct onto the drum wall and will be drawn out of the upper end of the drum. However, some small amounts of light materials will be mixed with the heavy materials falling onto the drum wall. These light materials will, of course, also be raised by the lifters and will eventually be removed by the air stream during the repetitive drops as the drum is rotated. Consequently substantially all of the light materials will eventually be separated and removed.

It will be noted that as the platform 38 and drum 16 are raised and lowered about the axis of the pivots 119, the hopper 10 will also move correspondingly and in doing so will describe an arc around the pivot axis 119. Thus, such movement of the hopper will cause an alteration in the spacial relationship between the hopper 10 and the adjacent end of the primary conveyor 12 such that improper loading of the hopper could occur.

To overcome this problem in accordance with this invention, a separate short section 120 of conveyor is mounted between the hopper 10 and the adjacent end of the primary conveyor 12. One end of conveyor section 120 is pivotally mounted beneath the adjacent end of the primary conveyor 12 as by a pivotal connection 22 on a support 124, and the conveyor section 120 is thus enabled to swing up and down about the axis of the connections 122.

Figure 5:
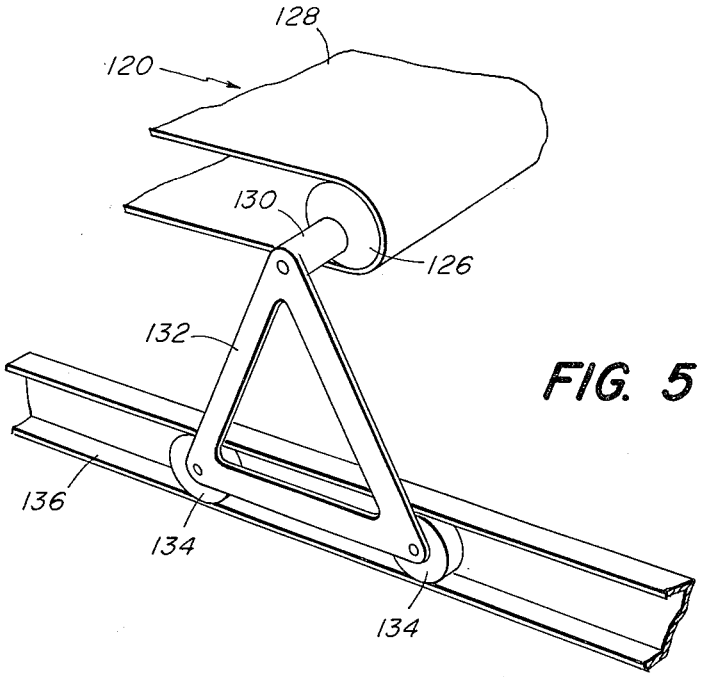
FIG. 5 is an enlarged isometric view of the adjustable cradle connecting the conveyor section to the hopper.

The other end of the conveyor section 120 includes a roller 126 (FIG. 5) over which conveyor belt 128 is wound. At each end of the roller 126 is a spindle 130 which is received in one corner of a triangular hanger 132. Rollers or wheels 134 are rotatably mounted at the other two corners of the hangers and are positioned within channel-like tracks 136 fixed to opposite sides of the hopper 10 at the upper end thereof.

Thus, when the hopper 10 moves up and down in response to vertical adjustment of the platform, the adjacent end of the conveyor section 120 will also move correspondingly, the adjacent end of the section retaining its spaced relation with the top of the hopper by virtue of the hangers and the rolling movement of the wheels 134 in tracks 136 which compensate for movement of the hopper in an arcuate path.

Accordingly, from the foregoing it will be apparent that all of the advantages and objectives of this invention have been achieved by the apparatus shown and described which provides means for feeding raw mixed materials into a hopper by conveyor means, and means for retaining the spacial relationship of the conveyor means to the hopper when the hopper is moved.

It is to be understood, however, that various modifications and changes in the apparatus shown and described may be made by those skilled in the art without departing from the spirit of the invention as expressed in the accompanying claims. Therefore, all matter shown and described is to be interpreted as illustrative and not in a limiting sense.

What is claimed is:

1. A rotary drum classification means for separating materials comprising an elongated vertically adjustable support, a hopper mounted on the support adjacent one end thereof and movable therewith for receiving materials to be classified from a primary conveyor, an open-ended drum rotatably mounted on the support and having one end disposed adjacent the end thereof opposite the hopper, conveying means for transporting materials from said hopper into said drum, pivotal means for supporting the support at the end thereof remote from the hopper, means for raising and lowering the support about the axis of said pivotal means for thereby adjusting the angle of inclination of the drum and consequently moving the hopper in an arcuate path with respect to said primary conveyor, and compensating conveyor means comprising a conveyor section for transporting materials from said primary conveyor to the hopper, connecting means for connecting the adjacent end of said conveyor section to the hopper for movement therewith, said conveyor section being pivotal at its other end beneath the adjacent end of the primary conveyor.

2. A means for separating materials as set forth in claim 1 wherein said connecting means includes means for permitting movement of the hopper with respect to the adjacent end of the conveyor section while retaining said adjacent end of the conveyor section in predetermined spaced relation from the upper end of the hopper during such movement.

3. A means for separating materials as set forth in claim 1 wherein said hopper is provided with at least one longitudinally extending track thereon, and said adjacent end of the conveyor section is provided with a trolley having rollers engaging and retained in said track for permitting movement of the hopper and track with respect to the conveyor section while retaining the adjacent end of the conveyor section in predetermined spaced relation from the upper end of the hopper during such movement.

4. A means for separating materials as set forth in claim 3 wherein said trolley comprises a hanger member pivotally connected at its upper end to and depending from said adjacent end of the conveyor section, and spaced rollers carried by the lower end of the hanger member, and said track comprises a channeled member within which said rollers are disposed for longitudinal movement therein, and said track having a longitudinally extending portion overlying said rollers to prevent upward or downward displacement of the rollers from the channel therein.

5. A means for separating materials as set forth in claim 4 wherein a separate connecting means is located on each side of the conveyor section and hopper.

6. A rotary drum classification means for separating materials comprising an elongated vertically adjustable support, a hopper mounted on the support adjacent one end thereof and movable therewith for receiving materials to be classified from a conveyor, an open-ended drum rotatably mounted on the support and having one end disposed adjacent the end thereof opposite the hopper, conveying means for transporting materials from said hopper into said drum, pivotal means for supporting the support at the end thereof remote from the hopper, means for raising and lowering the support about the axis of said pivotal means for thereby adjusting the angle of inclination of the drum and consequently moving the hopper in an arcuate path with respect to said conveyor, automatically adjustable connecting means for connecting the adjacent end of said conveyor section for maintaining the conveyor in proper loading relation to the hopper at any adjusted position of the hopper.

7. A means for separating materials as set forth in claim 6 wherein said connecting means is a trolley.

8. A means for separating materials as set forth in claim 7 wherein said hopper has tracks on its upper sides, and a trolley is carried by opposite sides of the conveyor and rollingly engages a respective track.

* * * * *